US007283116B2

(12) United States Patent
Shih et al.

(10) Patent No.: US 7,283,116 B2
(45) Date of Patent: Oct. 16, 2007

(54) SCAN DRIVER AND SCAN DRIVING SYSTEM WITH LOW INPUT VOLTAGE, AND THEIR LEVEL SHIFT VOLTAGE CIRCUIT

(75) Inventors: Jun-Ren Shih, Sioushuei Township, Changhua County (TW); Chia-Pao Chang, Taipei (TW); Bowen Wang, Shulin (TW); Jan-Ruei Lin, Jhonghe (TW)

(73) Assignee: Industrial Technolgy Research Institute, Chutung, Hsinchu (TW)

( * ) Notice: Subject to any disclaimer, the term of this patent is extended or adjusted under 35 U.S.C. 154(b) by 688 days.

(21) Appl. No.: 10/760,410

(22) Filed: Jan. 21, 2004

(65) Prior Publication Data

US 2005/0057553 A1 Mar. 17, 2005

(30) Foreign Application Priority Data

Aug. 25, 2003 (TW) ..... 92123305 A

(51) Int. Cl.
*G09G 3/36* (2006.01)

(52) U.S. Cl. ..... 345/100; 327/333

(58) Field of Classification Search ..... 345/98, 345/204, 205, 211–213, 690, 99, 100; 326/63, 326/80, 81; 327/333; 365/78; 377/64
See application file for complete search history.

(56) References Cited

U.S. PATENT DOCUMENTS

| | | | | |
|---|---|---|---|---|
| 6,580,411 | B1 * | 6/2003 | Kubota et al. | 345/98 |
| 6,909,417 | B2 * | 6/2005 | Washio et al. | 345/98 |
| 7,002,545 | B2 * | 2/2006 | Osame | 345/98 |
| 7,050,036 | B2 * | 5/2006 | Kim et al. | 345/100 |
| 7,057,598 | B2 * | 6/2006 | Azami et al. | 345/100 |
| 2004/0008193 | A1 * | 1/2004 | Yu | 345/204 |
| 2004/0032291 | A1 * | 2/2004 | Tseng | 327/333 |
| 2004/0109526 | A1 * | 6/2004 | Park et al. | 377/64 |

* cited by examiner

*Primary Examiner*—Amr A. Awad
*Assistant Examiner*—Tom V Sheng
(74) *Attorney, Agent, or Firm*—Bacon & Thomas, PLLC

(57) ABSTRACT

Scan driver and driving system with low input voltage and their level shift circuit are disclosed. The scan driver includes a latch unit, a level shift circuit and a buffer. The latch unit generates a first control signal and a second control signal. The level shift circuit is connected to the latch unit to receive the first control signal, the second control signal, a first clock signal and a second clock signal, so as to output a scan signal with high voltage level. The buffer enhances driving ability of the scan signal for driving thin-film transistors (TFTs) of a display panel.

8 Claims, 5 Drawing Sheets

SCAN DRIVER AND SCAN DRIVING SYSTEM WITH LOW INPUT VOLTAGE, AND THEIR LEVEL SHIFT VOLTAGE CIRCUIT

BACKGROUND OF THE INVENTION

1. Field of the Invention

The present invention relates to a scan driver and, more particularly, to a scan driver and a scan driving system with low input voltage, and their level shift voltage circuit.

2. Description of Related Art

Currently, in flat panel displays, thin-film transistors (TFTs) on a display panel are controlled by a driving unit essentially consisting of a data driver (source driver) and a scan driver (gate driver). The scan driver sequentially turns on TFTs of each column on the display panel through an internal output signal, so as to concurrently charge the column's display points (pixels) to corresponding required voltages and thus present different gray levels.

However, a voltage threshold $V_T$ for a transistor in a typical silicon process is approximate to 1 V and lower, and that for a TFT in a low temperature polycrystalline silicon (LTPS) TFT process is from about 2.5V to about 5V. For a 2V range of noises under such a high threshold, an input signal has to be greater than 4.5 V (2.5V+2V) to turn on TFTs, in order to gain a higher input voltage to drive the TFTs, resulting in consuming more power.

In related patents, U.S. Pat. No. 5,646,642 granted to Maekawa, et al. for a "Circuit for converting level of low-amplitude input" has disclosed a level shift circuit which can have a lower input voltage and a higher output voltage. However, it still needs more power because two current sources are applied. This cannot meet with strict requirement for power consumption. Therefore, it is desirable to provide an improved scan driver with low input voltage such as 3.3 V to drive TFTs on the display panel, so as to mitigate and/or obviate the aforementioned problems.

SUMMARY OF THE INVENTION

The object of the present invention is to provide a scan driver and a scan driving system with low input voltage, and their level shift voltage circuit, so as to drive corresponding scan drivers through a low voltage.

According to a feature of the present invention, a scan driver with low input voltage is provided. The scan driver implemented in a flat panel display with TFTs includes a latch unit and a level shift circuit. The latch unit generates a first control signal and a second control signal, which have opposite phases to each other. The level shift circuit includes first to fifth switch units. The first switch unit receives a first clock signal and a second clock signal and performs switching using the first control signal. The second switch unit is coupled between the first switch unit at both a first connection node and a second connection node and an operating voltage, to receive the first clock signal and the second clock signal through switching the first switch unit, thereby raising voltages at the first connection node and the second connection node to the operating voltage. The third switch unit is coupled between the first and second connection nodes and the operation voltage, to receive the first control signal and the second control signal through the latch unit and the first clock signal or the second clock signal through switching the first switch unit, thereby providing a stable processing. The fourth switch unit is coupled between the first and second connection nodes and the operating voltage, to perform switching of the fourth switch unit according to voltage levels of the first connection node and the second connection node. The fifth switch unit is connected to the fourth switch unit, to generate a scan signal to output according to the switching of the fourth switch unit.

According to another feature of the present invention, a scan driving system with low input voltage is provided. The scan driving system is formed by cascading a plurality of scan drivers. Each scan driver includes a latch unit and a level shift circuit. The latch unit generates a first control signal and a second control signal, which have opposite phases to each other. The level shift circuit includes first to fifth switch units. The first switch unit receives a first clock signal and a second clock signal and performs switching using the first control signal. The second switch unit is coupled between the first switch unit at both a first connection node and a second connection node and an operating voltage, to receive the first clock signal and the second clock signal through switching the first switch unit, thereby raising voltages at the first connection node and the second connection node to the operating voltage. The third switch unit connected is coupled between the first and second connection nodes and the operation voltage, to receive the first control signal and the second control signal through the latch unit and the first clock signal or the second clock signal through switching the first switch unit, thereby providing a stable processing. The fourth switch unit is coupled between the first and second connection nodes and the operating voltage, to perform switching of the fourth switch unit according to voltage levels of the first connection node and the second connection node. The fifth switch unit is connected to the fourth switch unit, to generate a scan signal to output according to the switching of the fourth switch unit.

According to a further feature of the present invention, a level shift circuit is provided. The level shift circuit includes first to fifth switch units. The first switch unit receives a first clock signal and a second clock signal and performs switching using the first control signal. The second switch unit is coupled between the first switch unit at both a first connection node and a second connection node and an operating voltage, to receive the first clock signal and the second clock signal through switching the first switch unit, thereby raising voltages at the first connection node and the second connection node to the operating voltage. The third switch unit connected is coupled between the first and second connection nodes and the operation voltage, to receive the first control signal and the second control signal through the latch unit and the first clock signal or the second clock signal through switching the first switch unit, thereby providing a stable processing. The fourth switch unit is coupled between the first and second connection nodes and the operating voltage, to perform switching of the fourth switch unit according to voltage levels of the first connection node and the second connection node. The fifth switch unit is connected to the fourth switch unit, to generate a scan signal to output according to the switching of the fourth switch unit.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
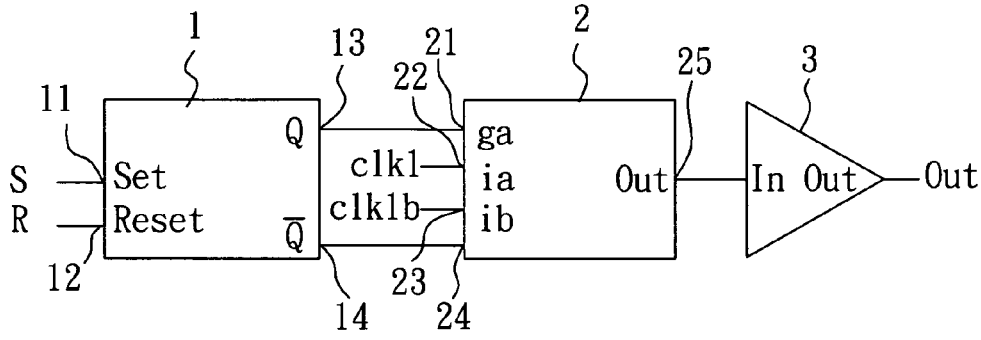
FIG. 1 is a functional diagram of an embodiment of the invention.

In accordance with a preferred embodiment of the invention, an example is given by implementing scan driver in a low temperature poly-silicon (LTPS) display. FIG. 1 is a functional diagram of the exemplary scan driver in accordance with the invention. In FIG. 1, the scan driver consists of a latch unit 1, a level shift circuit 2 and a buffer 3. An input terminal of the latch unit 1 has a set pin 11 and a reset pin 12, which correspond to a first control pin 13 and a second control pin 14 respectively to output. An input portion of the level shift circuit 2 has a first input pin 21, a first clock pin 22, a second clock pin 23 and a second input pin 24.

The set pin 11 of the latch unit 1 receives a set signal and the reset pin 12 receives a reset signal, such that corresponding outputs of the first control pin 13 and the second control pin 14 are determined by the corresponding set and reset signals. The outputs of the first control pin 13 and the second control pin 14 have phases opposite to each other. In this embodiment, the latch unit 1 is a SR latch.

The first input pin 21 of the level shift circuit 2 is connected to the first control pin 13 of the latch unit 1 and the second input pin 24 of the level shift circuit 2 is connected to the second control pin 14 of the latch unit 1. The first clock pin 22 and the second clock pin 23 respectively receive first clock signal clk1 and second clock signal clk1*b*, which have phases approximately opposite to each other, such that the level shift circuit 2 outputs a scan signal with higher voltage level according to outputs of the first control pin 13, the second control pin 14, the first clock signal and the second clock signal.

An output terminal 25 of the level shift circuit 2 is connected to the buffer 3, so as to enhance driving ability of the scan signal. The operation of the level shift circuit 2 to output the scan signal with higher voltage level is described hereinafter.

Figure 2:
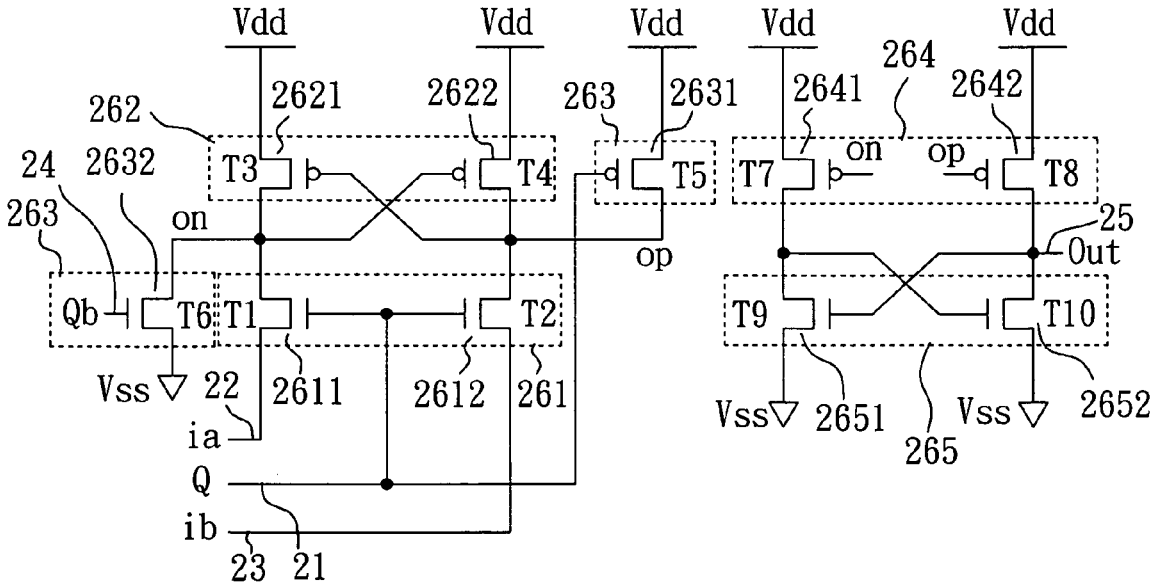
FIG. 2 is a schematic diagram of a level shift circuit in accordance with the embodiment of the invention.

FIG. 2 is a schematic diagram of the level shift circuit 2 of FIG. 1 in accordance with the invention. In FIG. 2, the level shift circuit 2 comprises a first switch unit 261, a second switch unit 262, a third switch unit 263, a fourth switch unit 264 and a fifth switch unit 265. The first switch unit 261 has two N-type thin film transistors (TFTs) 2611, 2612. The second switch unit 262 has two P-type TFTs 2621, 2622. The third switch unit 263 has one P-type TFT 2631 and one N-type TFT 2632. The fourth switch unit 264 has two P-type TFTs 2641, 2642. The fifth switch unit 265 has two N-type TFTs 2651, 2652.

In the first switch unit 261, source of the N-type TFT 2611 is connected to the first clock pin 22 in order to receive the first clock signal, source of the N-type TFT 2612 is connected to the second clock pin 23 in order to the second clock signal, and gates of the N-type TFTs 2611, 2612 are connected to the first input pin 21 in order to receive the output of the first control pin 13 of the latch unit 1.

In the second switch unit 262, drain of the P-type TFT 2621 is connected to drain of the N-type TFT 2611, drain of the P-type TFT 2622 is connected to drain of the N-type TFT 2612, sources of the P-type TFTs 2621, 2622 are connected to an operating voltage Vdd, gate of the P-type TFT 2621 is connected to drain of the N-type TFT 2612, and gate of the P-type TFT 2622 is connected to drain of the N-type TFT 2611.

In the third switch unit 263, drain of the P-type TFT 2631 is connected to drain of the N-type TFT 2612, source of the N-type TFT 2632 is connected to a low potential, source of the P-type TFT 2631 is connected to the operating voltage, drain of the N-type 2632 is connected to drain of the P-type TFT 2621, gate of the P-type TFT 2631 is connected to the first input pin 21 in order to receive the output of the first control pin 13 of the latch unit 1, and gate of the N-type TFT 2632 is connected to the second control pin in order to receive the output of the second control pin 14 of the latch unit 1.

In the fourth switch unit 264, sources of the P-type TFTs 2641, 2642 are connected to the operating voltage, gate of the P-type TFT 2641 is connected to drain of the N-type TFT 2611, gate of the P-type TFT 2642 is connected to drain of the P-type TFT 2631.

In the fifth switch unit 265, drain of the N-type TFT 2651 is connected to drain of the P-type TFT 2641 and gate of the N-type TFT 2652, drain of the N-type TFT 2652 is connected to drain of the P-type TFT 2642 and gate of the N-type TFT 2651, and sources of the N-type TFTs 2651, 2652 are connected to a low potential.

Figure 3:
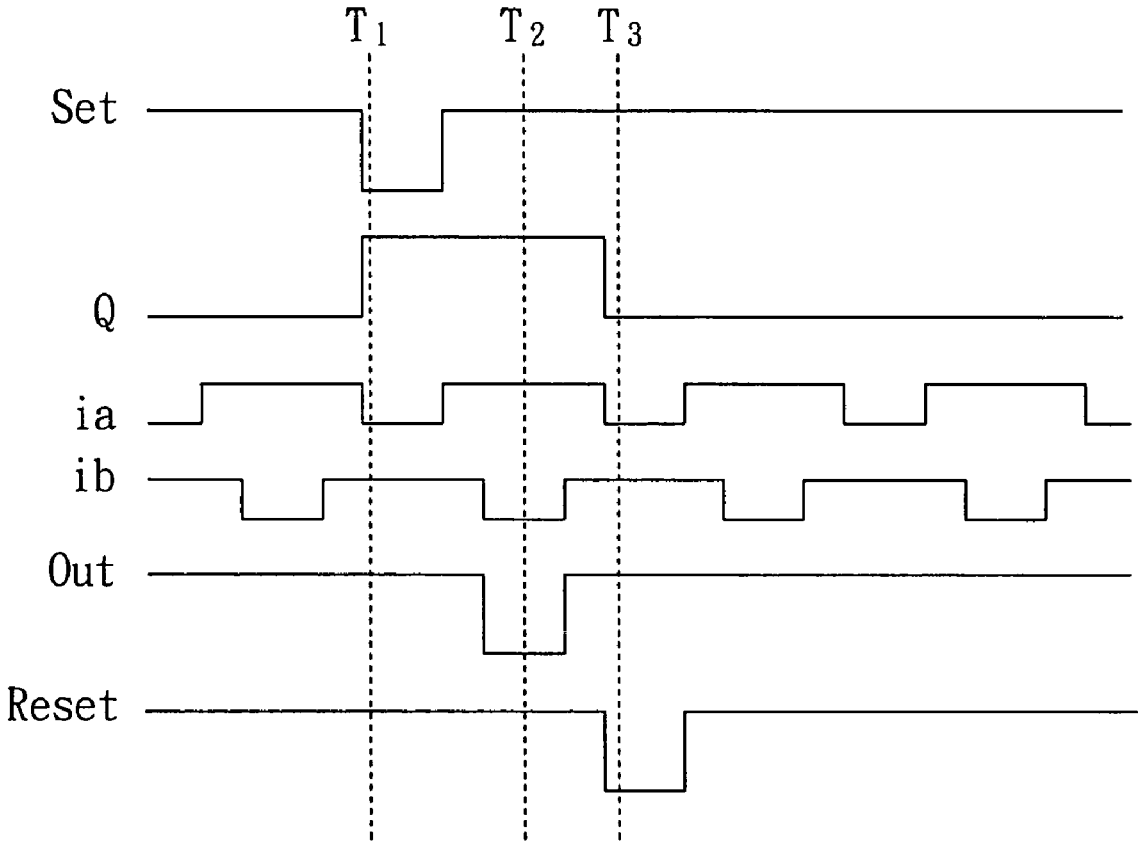
FIG. 3 is a timing of an operation of FIG. 2 in accordance with the embodiment of the invention.

Referring to FIGS. 1, 2 and 3 for the scan driver's operation. In FIGS. 1, 2 and 3, functional block diagram, schematic circuit diagram and timing diagram are respectively shown. As shown in FIG., 3 in connection with FIGS. 1 and 2, at T1, the set signal with low potential is inputted by the set pin 11 of the latch unit 1 and the reset signal with high potential is inputted by the reset pint 12 of the latch unit 1, so as to output the first control signal Q with high potential through the first control pin 13 and output the second control signal $\overline{Q}$ with low potential through the second control pin 14 according to features of the latch unit 1 such as SR latch. Accordingly, gates of the N-type TFTs 2611, 2612 have high potential and thus are turned on. Next, the P-type TFT 2631 and the N-type TFT 2632 are turned off.

Since the first clock signal is at low potential and the second clock signal is at high potential, the P-type TFT 2622 is turned on and the P-type TFT 2621 is turned off, such that the P-type TFT 2641 is turned off, the P-type TFT 2642 is turned on, the N-type TFT 2651 is turned on and the N-type TFT 2652 is turned off, so as to output a high voltage close to the operating voltage. At T2, the first clock signal becomes a high potential and the second clock signal becomes a low potential, the P-type TFT 2622 is turned off and the P-type TFT 2621 is turned on such that the P-type TFT 2641 is turned on, the P-type TFT 2642 is turned off, the N-type TFT 2651 is turned off and the N-type TFT 2652 is turned on, so as to pull the potential at the output terminal 25 of the level shift circuit 2 down to a low potential.

At T3, a reset signal is inputted by the reset pin 12 of the latch unit 1 in order to output to the latch unit 1. Because the reset signal has a low potential, the latch unit 1 outputs a high potential through its second control pin 14 and outputs a low potential through its first control pin 13. Accordingly, gates of the N-type TFTs 2611, 2612 are at low potential and thus are turned off. Next, the P-type TFT 2631 and the N-type TFT 2632 are turned on, so as to pull the voltage at a node, denoted as 'op', up to the high voltage Vdd and the voltage at a node, denoted as 'on', down to a low voltage Vss for maintaining in stable state.

Thus, the P-type TFT 2642 is turned on and the P-type TFT 2641 is turned off, such that the N-type TFT 2651 is turned on and the N-type TFT 2652 is turned off, thereby completely outputting the signal of a scan waveform.

As cited above, the first switch unit 261 and the fourth switch unit 264 function as switching. Also, the first switch unit 261 and the second switch unit 264 are used to pull the first clock signal of the first clock pin 22 and the second signal of the second clock pin 23 up to a level of the operating voltage, but only one of the units 261 and 264 is active at the same time, for example from (0, 3.3V) to (0, Vdd). The third switch unit 263 provides a stable processing. The fourth switch unit 264 functions as a switching for the fifth switch unit 265 which can pull down its voltage level according to the switching operation of the fourth switch unit 264 in order to output the scan signal. Thus, it is achieved that a scan signal with higher voltage is output by applying a clock signal with a level of low voltage to the control of the switch units. In this embodiment, the first clock signal and the second clock signal have 0 to 3.3V voltage range each, the scan signal has the same level as the operating voltage, i.e., 10V, and the low voltage is −10V.

Figure 4:
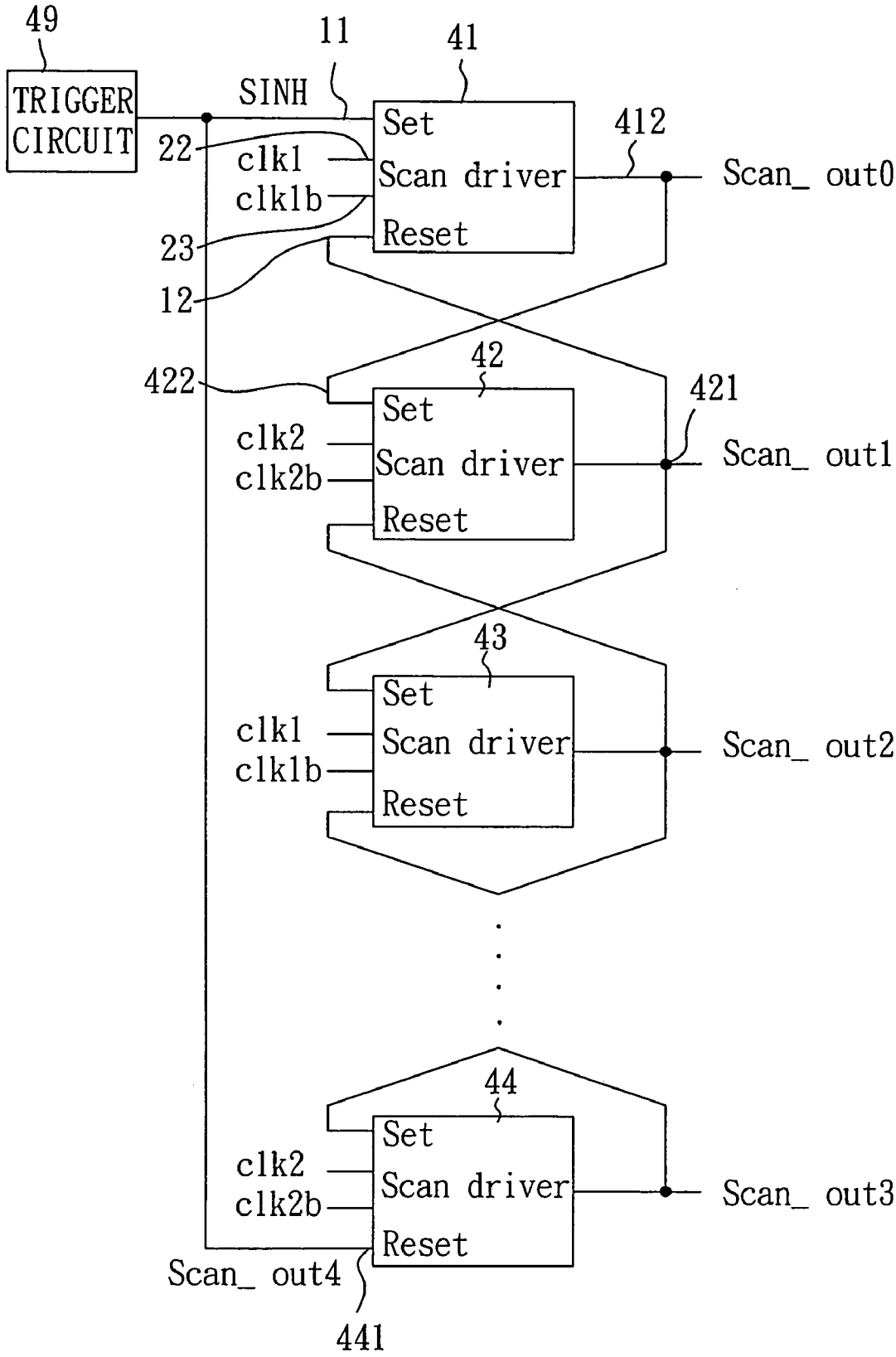
FIG. 4 is a schematic diagram of multiple scan drivers in accordance with an embodiment of the invention.
Figure 5:
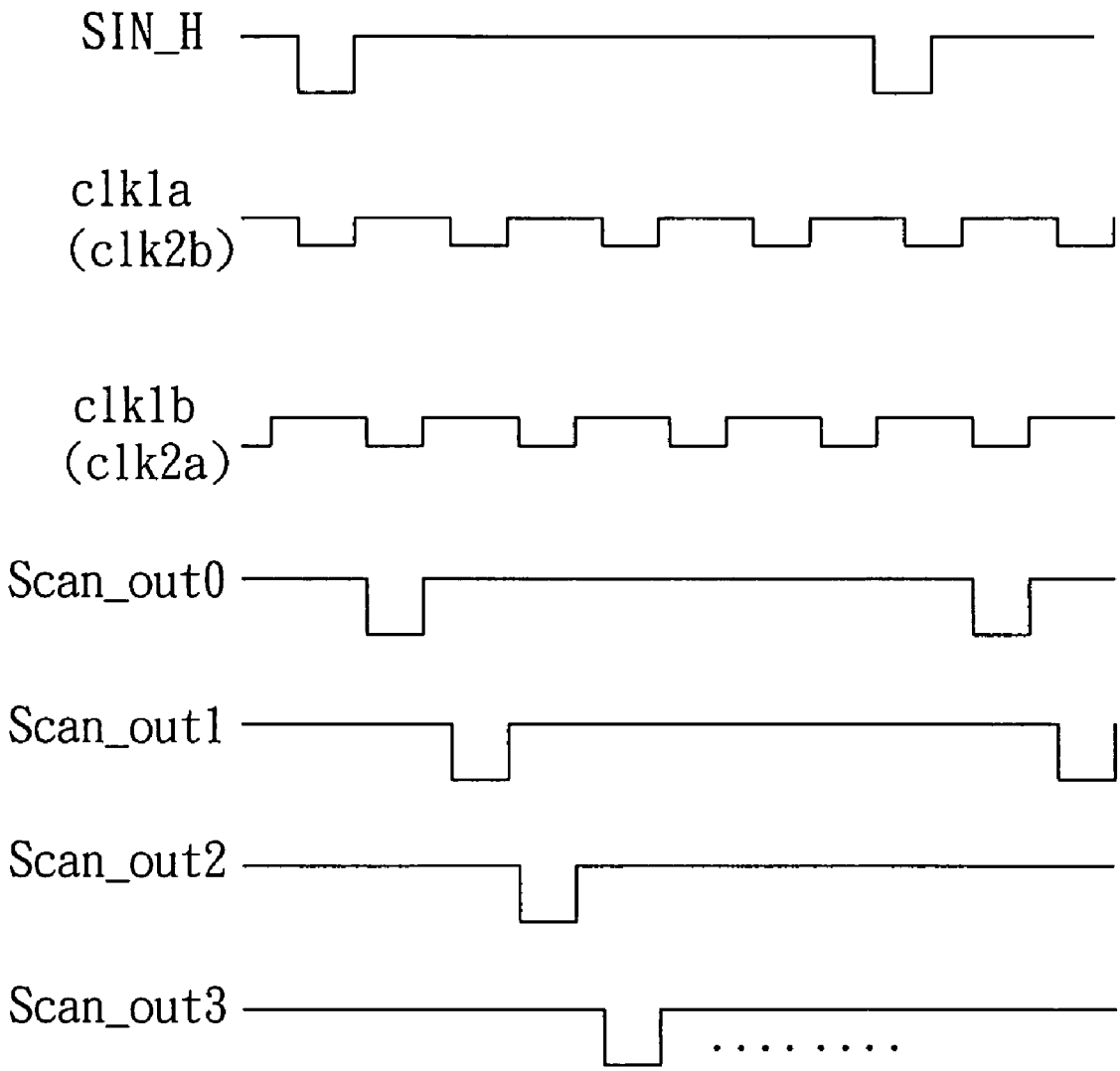
FIG. 5 is a timing of scan wave outputs of FIG. 4 in accordance with the embodiment of the invention.

A flat panel display mostly installs a plurality of scan drivers to turn on TFTs on its panel. FIG. 4 is a schematic diagram of a plurality of scan drivers 41, 42, 43, 44. As shown in FIG. 4, output terminal 412 of a first scan driver 41 is connected to a set pin 422 of next scan driver 42. Output terminal 421 of the next scan driver 42 is connected to a reset pin 12 of the previous scan driver 41. Each scan driver is connected to a first clock signal and a second clock signal. A set pin 11 of the first scan driver 41 and the reset pin 441 of the last scan driver 44 are connected to output terminal of a trigger circuit 49. The scan drivers 41-44 receive the first clock signal and the second clock signal through the first clock pin 22 and the second clock pin 23 respectively, to generate the set signal or the reset signal for controlling the scan drivers 41-44 to thus form scan waves shown in FIG. 5.

Figure 6:
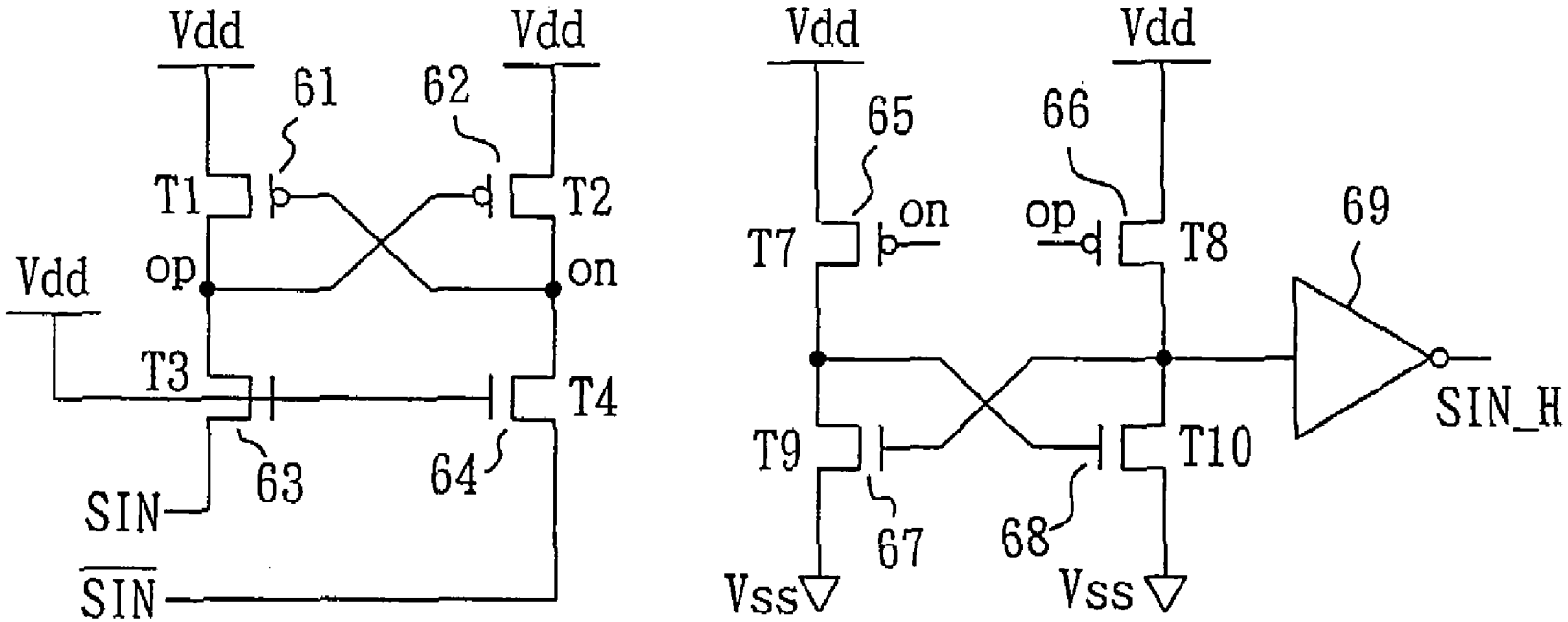
FIG. 6 is a schematic diagram of an internal circuit of a trigger circuit of FIG. 4 in accordance with the embodiment of the invention.

FIG. 6 is a schematic diagram of an internal circuit of the trigger circuit 49 of FIG. 4. In FIG. 6, the trigger circuit 49 essentially includes four P-type TFTs 61, 62, 65, 66, four N-type TFTs 63, 64, 67, 68 and an inverter 69. As shown in FIG. 6, the N-type TFTs 63, 64 are connected to a third clock signal and a fourth clock signal, which have opposite phases to each other. The P-type TFTs 61, 62, 65, 66 are connected to the operating voltage Vdd, to generate the reset or set signal through the third clock signal and the fourth clock signal.

In view of foregoing, it is known that the invention uses the latch unit to generate the first control signal and the second control signal, which have opposite phases to each other, to the level shift circuit, and the level shift circuit receives the first clock signal and the second clock signal, to generate a scan signal according to the first control signal, the second control signal, the first clock signal and the second clock signal. Therefore, the first clock signal and the second clock signal are provided with low voltage and accordingly the scan signal with high voltage is outputted to drive TFTs of a display panel.

Although the present invention has been explained in relation to its preferred embodiment, it is to be understood that many other possible modifications and variations can be made without departing from the spirit and scope of the invention as hereinafter claimed.

What is claimed is:

1. A scan driver with low input voltage, implemented in a flat panel display with a plurality of thin-film transistors (TFTs), the scan driver comprising:

a latch unit, to generate a first control signal and a second control signal, which have opposite phases to each other; and a level shift circuit, having:

a first switch unit, to receive a first clock signal and a second clock signal, and to perform switching using the first control signal;

a second switch unit, coupled between the first switch unit at both a first connection node and a second connection node and an operating voltage, to receive the first clock signal and the second clock signal through switching the first switch unit, thereby raising voltages at the first connection node and the second connection node to the operating voltage;

a third switch unit, coupled between the first and second connection nodes and the operation voltage, to receive the first control signal and the second control signal through the latch unit, and to receive the first clock signal or the second clock signal through switching the first switch unit, thereby providing a stable processing;

a fourth switch unit, coupled between the first and second connection nodes and the operating voltage, to perform switching of the fourth switch unit according to voltage levels of the first connection node and the second connection node; and a fifth switch unit, connected to the fourth switch unit, to generate a scan signal to output according to the switching of the fourth switch unit.

2. The scan driver as claimed in claim 1, further comprising a buffer, connected to the level shift circuit, to receive the scan signal for enhancing driving ability of the scan signal.

3. The scan driver as claimed in claim 1, wherein the latch unit is an SR latch.

4. A scan driving system, formed by cascading a plurality of scan drivers, each scan driver comprising:

a latch unit, to apply a set pin and a reset pin respectively to generate a first control signal and a second control signal, which have opposite phases to each other; and a level shift circuit, having:

a first switch unit, to receive a first clock signal and a second clock signal, and to perform switching using the first control signal;

a second switch unit, coupled between the first switch unit at both a first connection node and a second connection node and an operating voltage, to receive the first clock signal and the second clock signal through switching the first switch unit, thereby raising voltages at the first connection node and the second connection node to the operating voltage;

a third switch unit, coupled between the first and second connection nodes and the operation voltage, to receive the first control signal and the second control signal through the latch unit, and to receive the first clock signal or the second clock signal through switching the first switch unit, thereby providing a stable processing;

a fourth switch unit, coupled between the first and second connection nodes and the operating voltage, to perform switching of the fourth switch unit according to voltage levels of the first connection node and the second connection node; and a fifth switch unit, connected to the fourth switch unit, to generate a scan signal to an output terminal according to the switching of the fourth switch unit.

5. The scan driving system as claimed in claim 4, wherein in the plurality of scan drivers, a set pin of the first scan driver and a reset pin of the last scan driver are connected to a trigger circuit.

6. A level shift circuit, comprising:

a first switch unit, to receive a first clock signal and a second clock signal, and to perform switching using a first control signal;

a second switch unit, coupled between the first switch unit at both a first connection node and a second connection node and an operating voltage, to receive the first clock signal and the second clock signal through switching the first switch unit, thereby raising voltages at the first connection node and the second connection node to the operating voltage;

a third switch unit, coupled between the first and second connection nodes and the operation voltage, to receive the first control signal and a second control signal, and to receive the first clock signal or the second clock signal through the first switch unit on and off, thereby providing a stable processing;

a fourth switch unit, coupled between the first and second connection nodes and the operating voltage, to perform switching of the fourth switch unit according to voltage levels of the first connection node and the second connection node; and a fifth switch unit, connected to the fourth switch unit, to generate a scan signal to output according to the switching of the fourth switch unit.

7. The level shift circuit as claimed in claim 6, wherein each of the first to fifth switch units has a plurality of switching devices.

8. The level shift circuit as claimed in claim 7, wherein the switching devices are TFTs.

* * * * *